US006930082B2

(12) United States Patent
Harichian et al.

(10) Patent No.: US 6,930,082 B2
(45) Date of Patent: Aug. 16, 2005

(54) FABRIC SOFTENING COMPOSITIONS

(75) Inventors: Bijan Harichian, New Jersey, NJ (US); Christopher Whaley, Merseyside (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 190 days.

(21) Appl. No.: 10/276,185

(22) PCT Filed: Mar. 7, 2002

(86) PCT No.: PCT/EP02/02623

§ 371 (c)(1),
(2), (4) Date: Mar. 3, 2003

(87) PCT Pub. No.: WO02/088287

PCT Pub. Date: Nov. 7, 2002

(65) Prior Publication Data

US 2003/0181346 A1 Sep. 25, 2003

(30) Foreign Application Priority Data

Mar. 15, 2001 (GB) ..... 0106466

(51) Int. Cl.[7] ..... C11D 1/66
(52) U.S. Cl. ..... 510/515; 510/470
(58) Field of Search ..... 510/515, 520, 510/522, 527, 499, 505, 506, 470

(56) References Cited

U.S. PATENT DOCUMENTS

| | | | | |
|---|---|---|---|---|
| 3,598,865 A | | 8/1971 | Lew | |
| 3,637,495 A | | 1/1972 | Heins et al. | |
| 3,954,873 A | * | 5/1976 | Gipson | 564/506 |
| 5,401,426 A | | 3/1995 | Gerling et al. | |
| 5,712,243 A | | 1/1998 | Gutierrez et al. | |
| 5,789,372 A | | 8/1998 | Fabry | |

FOREIGN PATENT DOCUMENTS

| | | |
|---|---|---|
| EP | 0 239 910 B1 | 10/1992 |
| EP | 0 380 406 B1 | 11/1995 |
| EP | 0 550 278 A | 9/1996 |
| GB | 1 409 416 | 10/1975 |
| GB | 2 185 991 A | 8/1987 |
| GB | 2 185 992 A | 8/1987 |
| WO | 95/27770 A1 | 10/1995 |
| WO | 98/00492 A1 | 1/1998 |

OTHER PUBLICATIONS

M. Goto et al., Journal of Chemical Engineering of Japan (1987), 20(2) pp. 157–164. Feb. 1987.*
H. Zhang et al., Gaodeng Xeuxiao Huaxue Xuebao (1992), 13(6) pp. 816–818 (abstract). Jun. 1992.*
International Search Report No. PCT/EP 02/02623 dated Jul. 23, 2002, 2 pp.
UK Search Report No. GB 0106466.6 dated Aug. 21, 2001, 1 page.

* cited by examiner

*Primary Examiner*—John R. Hardee
(74) *Attorney, Agent, or Firm*—Ellen Plotkin

(57) ABSTRACT

Fabric softening products, such as a rinse conditioner or a tumble dryer sheet, comprise (a) an organic softening compound free of quaternary nitrogen groups and having the general formula (1) wherein $R_1$ and $R_2$ are both hydrophobic alkyl or alkenyl groups independently comprisng 5 to 40 carbon atoms and together comprising at least 26 carbon atoms, L is a linking group having at least 1 single bond providing freedom of rotation and providing a chain length of from 4 to 10 atoms between Q and $R_1/R_2$ and Q is a hydrophilic head group; and (b) a carrier for the softening compound.

15 Claims, No Drawings

FABRIC SOFTENING COMPOSITIONS

TECHNICAL FIELD

This invention relates to compositions for use in softening of fabrics during the laundry process.

BACKGROUND OF THE INVENTION

When fabrics are washed they acquire a rougher texture which feels harsh to the skin. Cotton fabrics are particularly affected. To counteract this, many consumers add fabric softening compositions to the rinse water. These fabrics softening compositions are generally an aqueous dispersion of material with a cationic head group and 1 or 2 alkyl chains which are attached to the head group and are of sufficient length to make the cationic material insoluble in water. This cationic material is then deposited on the fabric, and causes the fabric to have a softer feel.

Fabric softening can also be carried out in a tumble dryer. For this, the consumer uses a sponge, porous sheet or other article which has been impregnated with a cationic fabric softening agent similar to those used in an aqueous dispersion.

There have also been proposals to formulate a detergent composition so that a fabric softening effect is provided during the washing of the fabrics rather than during a rinsing step. Such softening can be accomplished using certain clays which have ion exchange properties. It has also been proposed to use certain nonionic materials to give fabric softening during washing.

U.S. Pat. No. 5,401,426 discloses that certain lactobioamides, which are nonionic surfactant materials contain a single $C_{14}$ to $C_{18}$ alkyl or alkenyl chain, may be used as softening agent in a rinse conditioner composition.

GB 1409416 discloses that sucrose distearate may be included in a combination of fabric softening agents in a rinse conditioner composition.

U.S. Pat. No. 3,598,865 discloses the manufacture of surface active alkyl glycosides by reacting a monosaccharide or a compound hydrolysable to a monosaccharide with a monohydric alcohol having from 8 to 25 carbon atoms. It is mentioned that this alcohol may be primary or secondary, straight or branched chained. It is also briefly mentioned that the glycosides may be used for a variety of purposes including textile softeners. The document does not give guidance for more specific selection of alkyl glycosides for use as textile softeners.

GB-A-2185991 teaches a detergent composition in which fabric softening is provided by the incorporation of an alkyl glycoside. GB-A-2185992 discloses detergent compositions which contain an alkyl glycoside jointly with a quaternary ammonium compound and other materials. In both of these documents the alkyl glycoside is broadly defined as having 1 or more hydrophobic groups containing 1 to 30 carbon atoms per hydrophobic group, and a hydrophilic glycoside group. Preferred alkyl glycosides are described as having a single alkyl chain.

EP-A-380406 discloses a detergent composition containing anionic and nonionic surfactants together with a sugar ester as a fabric softening agent. The sugar ester is defined as containing at least one fatty acid chain.

We have now found that fabric softening can be achieved using a product in which the fabric softening agent is one or more organic compounds which are free of cationic quaternary nitrogen groups and bear two hydrophobic aliphatic chains attached through a linking group to a polyhydroxylated, hydrophilic head group. The compound (s) are preferably substantially nonionic.

The present invention is thus able to provide compositions in which fabric softening can be achieved without the use of quaternary ammonium materials, or with a reduced content of such materials.

Rinse conditioner formulations which contain a cationic fabric softening material are generally formulated as aqueous dispersions. It is not a simple matter to formulate an aqueous dispersion which will be stable during storage under varying temperatures, possibly even including exposure to temperatures below freezing. For some markets it is desired or required to use a fabric softening agent which is biodegradable. For quaternary ammonium fabric softeners this has been achieved by the use of materials containing an ester linkage but it is then necessary to guard against hydrolytic instability of the ester linkage, (which is the subject of European Patent 239910).

The use of a non-quaternary fabric softening material in accordance with the present invention can assist in the formulation of a product which is storage stable. Some forms of the fabric softening material can provide biodegradability without problems of hydrolytic instability.

Further advantages of a composition based on non-quaternary material are that it will avoid interfering with detergency when the fabrics are next washed with a detergent composition containing anionic detergent; it can assist perfume delivery, and can factilitate the preparation of concentrated products with good physical stability, even when subjected to low or high temperature.

SUMMARY OF THE INVENTION

Broadly, the present invention provides a fabric softening product which comprises:

(a) as a softening agent, at least one organic compound of the general formula:

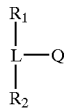

which does not contain any cationic quaternary nitrogen group and in which formula:

Q denotes a hydrophilic head group containing at least three free hydroxyl groups, $R_1$ and $R_2$ each independently denote a hydrophobic aliphatic chain of 5 to 40 carbon atoms optionally interrupted by a heteroatom, provided that $R_1$ and $R_2$ together contain at least 26 carbon atoms, and L denotes a linking group providing at least 1, preferably 2, single bond capable of providing freedom of rotation and a chain of at least 4 atoms, but not more than 10 atoms, between Q and $R_1$ and between Q and $R_2$, and b) a carrier therefor.

DETAILED DESCRIPTION OF THE INVENTION

Compound (a) is an organic compound not possessing a cationic quaternary nitrogen group, although it may contain a nitrogen atom, such as in an amine group which may optionally be present in its protonated form.

It is particularly envisaged that the product will be a so-called rinse conditioner suitable for addition to an aqueous rinse liquor, the carrier material being such that the organic fabric softening compound(s) will disperse in the rinse liquor upon addition of the product thereto. However, the carrier material could be a detergent composition, with the organic softening compound(s) serving to give softening during the wash.

The washing and rinsing of fabrics may be carried out in an automatic washing machine which pumps a majority of the wash liquor away from the fabrics before contacting them with the rinse water. Such a machine may mix the rinse conditioner composition with the rinse water as that water is drawn into the machine—and therefore just before it is brought into contact with the fabrics. However, the above method could also be carried out using a different type of machine or by hand, such that the wet fabrics are taken out of the wash liquor and allowed to drain before immersion in the rinse water.

The product may also be suitable for use in a tumble dryer. In preferred tumble dryer products the softening organic compound(s) impregnate a carrier which is a porous carrier article.

It is desirable that the fabric softening organic compound or mixture of such compounds should form a liquid crystal phase in water, especially a hydrated solid or lamellar phase. This can promote softening and, for a product which is an aqueous rinse conditioner, it can assist in obtaining dispersion in the aqueous carrier. To obtain such a phase, we have found it desirable that the hydrophilic head group, Q, of the molecule and the hydrophobic portion formed by the two alkyl chains, $R_1$ and $R_2$, should both be of some size, e.g. comprising up to 40 carbon atoms, while the linking group, L, should be relatively compact, e.g. comprising a chain of less than 10 atoms.

It is especially preferred that the non-quaternary organic fabric softening compound or the mixture of such compounds form an $L_\beta$ lamellar liquid crystal phase when dispersed at a concentration of 1% by weight in deionised water at 20° C. and adjusted to pH 7.

The formation of a suitable non-micellar liquid crystal phase can be confirmed by optical microscopy and other phase behaviour characterisation techniques as described by Small D M, "Handbook of Lipid Research, Vol 4: The Physical Chemistry of Lipids" Plenu Press NY, 1986.

A characteristic of compounds which provide the preferred $L_\beta$ or hydrated solid phases is that an aqueous mixture, containing the compound or mixture of compounds at a total concentration of 5% by weight based on the total weight of the composition undergoes an endothermic phase transition at a temperature above 0° C., better above 5° C. or 10° C. This phase transition is detectable by differential scanning colorimetry and is attributable to "melting" the hydrated solid or the hydrocarbon chains of the $L_\beta$ phase.

Hydrophilic head group Q denotes an aliphatic group (i) containing three or more, preferably five or more free hydroxyl groups. These aliphatic groups may conveniently be derived from saccharide or a saccharide derivative such as a reduced sugar (i.e. a sugar alcohol). Mixtures of saccharides and/or their derivatives may be used. It is preferred that Q is a mono-or disaccharide, and most preferably a disaccharide or a derivative thereof.

In the hydrophilic head group, Q, it is desirable that there is at least one hydroxyl group for every two carbon atoms present. Preferred compounds contain at least four free hydroxyl groups and may have at least two hydroxyl groups for every three carbon atoms present in the hydrophilic portion of the molecule. In order that the hydrophilic group is of sufficient size it may be desirable that it contains at least six hydroxyl groups.

Hydrophilic head group, Q, may be ethoxylated, since this does not change the number of free hydroxyl groups. Alkoxylation with propylene oxide or higher alkylene oxide is possible, but usually is not desirable. Indeed it will generally be desirable that residues of propylene oxide or any higher alkylene oxide are absent.

It is preferred that hydrophilic head group, Q, includes residues of more than one glycoside. The number present may have an average value which is not necessarily an integer—for instance if group (i) is provided by a polyglycoside.

More particularly, some preferred forms of hydrophilic head group, Q, incorporate at least one glycoside ring, bearing free hydroxyl groups, and a carbon chain, also bearing hydroxyl groups. Such a group may be derived from a di- or oligo-saccharide by a reaction which opens one ring at the same time as adding a desired functional group. Examples of such reactions will be referred to in more detail below.

It may not be essential that the hydrophilic group is derived from saccharide. However, saccharides and reduced saccharides are a convenient source of chemical structures with multiple hydroxyl groups in proximity to one another. When Q comprises a monosaccharide residue or sterically smaller species, it is especially preferred that L contains an amine functionality.

The hydrophobic aliphatic chains, $R_1$ and $R_2$, independently denote a hydrophilic aliphatic chain of 5 to 40 carbon atoms optionally interrupted by a heteroatom. $R_1$ and $R_2$ together contain at least 26 carbon atoms. Typically $R_1$ and $R_2$ are both alkyl or alkenyl groups. Chain lengths up to and including 18 carbon atoms are likely to be used. Chain lengths up to 22 and 24 carbon atoms are possible. Even longer chains are less easy to provide, but can be provided as shorter carbon chains connected through heteroatoms, thus providing longer alkyl or alkenyl aliphatic chain interrupted by a heteroatom(s) such as

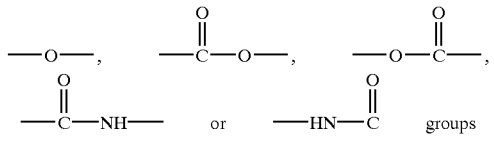

Preferably each of the chains, $R_1$ and $R_2$, independently comprise from 10 to 22, more preferably 14 to 20, e.g. 16 to 18 carbon atoms, as long as $R_1$ and $R_2$ together contain at least 26 carbon atoms. We have observed that particularly effective softening is provided when both groups $R_1$ and $R_2$ are saturated. However, partially unsaturated chains and chains with branching at any of the carbon atoms provide compounds within the scope of the invention.

L denotes a linking group between Q and $R_1$, and Q and $R_2$. It comprises a chain of at least 4 atoms but not more than 10 atoms between Q and $R_1$ and a chain of at least 4 atoms but not more than 10 atoms between Q and $R_2$ and has at least 1 single bond capable of providing freedom of rotation.

This excludes single bonds such as

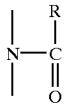

which do not have freedom of rotation. It is especially preferred that L has at least 2 single bonds providing freedom of rotation. L is preferably acyclic. The chain lengths between Q and $R_1$ and Q and $R_2$ may be the same or different.

L may contain amine functionality. It is particularly preferred that it comprises an amine group of formula:

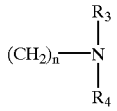

where n is 2 or 3 and $R_3$ and $R_4$ are independently selected from H or $CH_3$.

Alternatively, L may comprise an amide of formula:

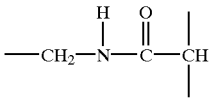

A suitable compound comprising a linking group, L, according to the above formula is:

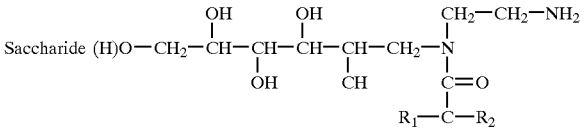

Preferably L provides 4 to 9 atoms between the Q group and $R_1$ and the Q group and $R_2$, more preferably 4 to 6 atoms.

The linking group, L, in the organic fabric softening compound may be attached to a hydroxyl-substituted carbon atom in the hydrophilic head group, Q.

The formula for such compounds may be depicted as:

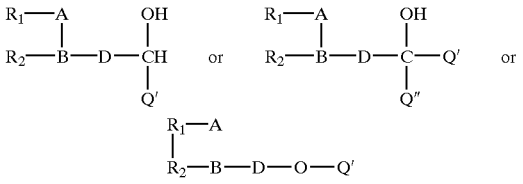

Where A, B and D denotes atoms or groups of atoms forming the linking group, L, while Q' and Q" denote parts of the hydrophilic head group, Q. The atoms or groups A or D or both may be absent. In any case, there must be at least 4 atoms between Q and $R_1/R_2$. It will generally be the case that the linking group does not bear any free hydroxyl groups. The hydrophobic chains, $R_1$ and $R_2$ may attach to a heteroatom or a carbon atom within the linking group, L, but not the carbon atom of a methylene group, which should be treated as part of the groups $R_1$ and $R_2$. $R_1$ and $R_2$ may or may not both attach to the same atom within the linking group, L.

Attachment of the hydrophobic chains, $R_1$ and $R_2$, through the linking group, L, to the hydrophilic part of the molecule, Q, may be brought about by various synthesis routes, but in many linking groups the connection to the carbon chain of the hydrophilic portion, Q, passes through a heteroatom in the linking group, L. The heteroatom will usually be oxygen, for example in an ester linkage, or nitrogen, for example in an amine or amide group.

A number of preferred categories of compounds suitable as fabric softening actives for this invention, and synthetic routes for obtaining them will now be discussed in more detail.

Product Obtained by Reductive Amination

As a first step, a mono-, di- or polysaccharide is reacted with ammonia or an amine to form an amino sugar which is then reduced so as to open the ring which bears the amino group. The amino group can be further reacted, for example with a dialkyl acid, to give the softener.

The reaction scheme below illustrates this procedure when the starting materials are maltose and methylamine.

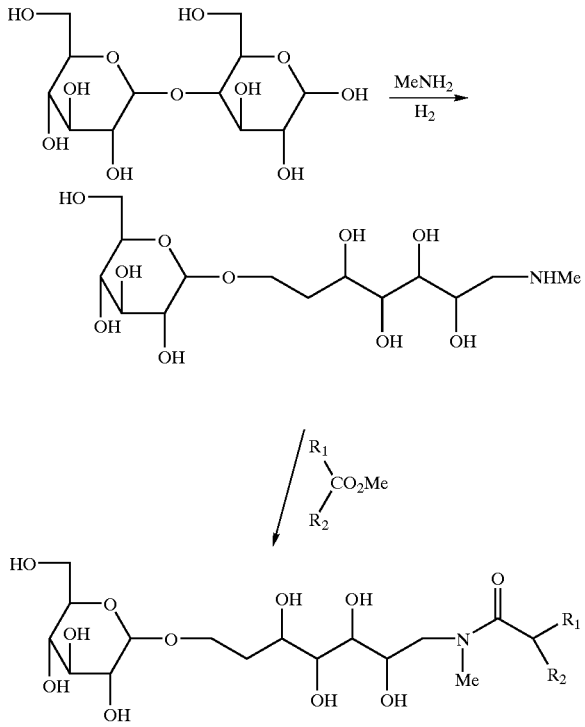

Other amines can be used, preferably with short carbon chains. Substituted alkyl amines, such as ethanolamine can be used similarly.

Reductive amination reactions of this kind are described in U.S. Pat. No. 5,188,769. After an amino or substituted amino group has been introduced the resulting intermediate amino sugar can be reacted with a Guerbet acid or corresponding acid chloride or ester incorporating two hydrophobic aliphatic chains. The Guerbet acids are known materials available from Condea.

Products from this route can be represented by a general formula:

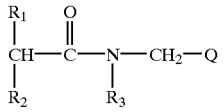

In the linking group

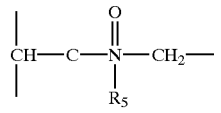

The group $R_5$ may be hydrogen, or $C_1$ to $C_3$ alkyl or hydroxyalkyl.

Amide materials including a sizeable spacer group may be made by a variety of techniques; for example:

1. An intermediate, suitable for reaction with an amino sugar made by reductive amination, is a dialkyl amino ester prepared from a secondary amine and a (meth) acrylate ester, thus:

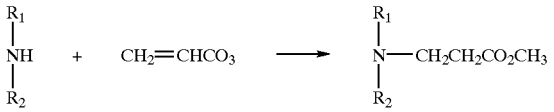

This would lead to compounds in which the linking group is:

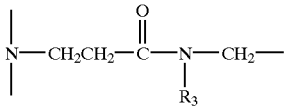

Products Obtained by Direct Amidation

Sugar lactones and uronic acid esters can be amidated directly utilising a primary amine substituted with the required alkyl or alkenyl groups. The reaction scheme below illustrates this synthetic route using a dialkyl diamine to react with glucono-1,5-lactone (which is commercially available, ex Acros Organics N.V.)

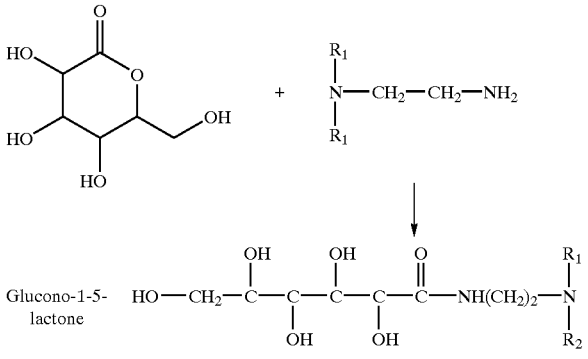

A preferred group of compounds accessible by reaction with lactones are aldobionamides.

Aldobionic acids are disaccharides or polysacchardies in which the aldehyde group (generally found at the $C_1$ position of the sugar) has been replaced by a carboxylic acid. Upon drying they cyclise to aldebionolactones. Aldobionamides are amides of an aldobionic acid (or aldobionolactone).

An aldobionamide may be based on compounds comprising two saccharide units or on compounds comprising more than two saccharide units, as long as the terminal sugar in the polysaccharide has an aldehyde group. Disaccharide compounds are preferred.

Aldobionamides used in the present invention can be represented by the general formula given earlier:

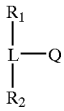

where Q is preferably derived from a di- or polysaccharide and contains at least one carbohydrate ring together with an acyclic polyhydroxy alkyl chain, derived from an opened carbohydrate ring which is attached to L.

The linking group, L, includes at least one nitrogen atom, and a short carbon chain, such as a $C_3$ to $C_6$ chain.

Examples of suitable linking groups, L, for aldobionamides include

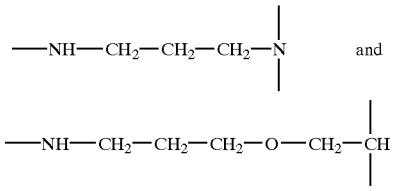

Other examples of aldobionamides (disaccharides) which may be used include cellobionamides, melibionamides and gentiobionamides.

Further information about aldobionamides and their preparation (although not with two long chains, $R_1$ and $R_2$) is given in EP-A-550278.

Another intermediate, useful for making aldobionamides with a sizeable spacer group in the linking group, L, is a compound of the formula:

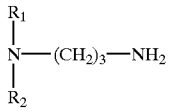

which can be prepared by reacting the diaraine $R_1R_2NH$ with acrylonitrile (according to J. Am. Chem. Soc., vol 106 no. 6 1984) followed by reduction with lithium aluminium hydride. This intermediate can then be reacted with an aldobionolactone.

Another approach to the preparation of aldobionamides is to react an aldobionolactone with a diamine which carries a single alkyl substituent, and then acylate the resulting intermediate, thus:

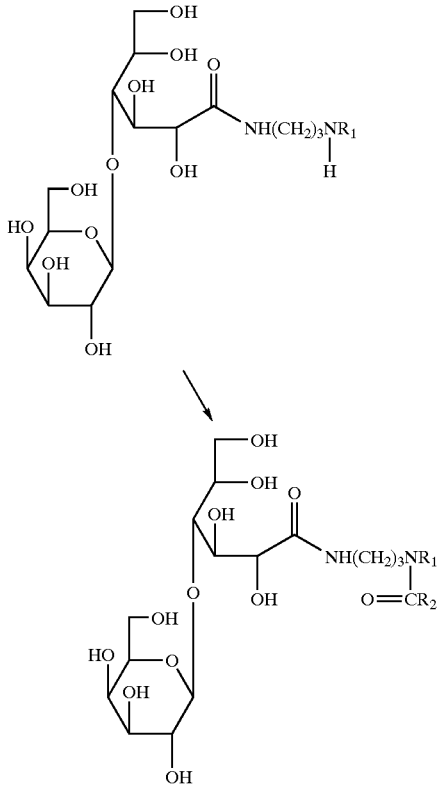

Glycosidation

Alkyl polyglycosides with a single alkyl chain, notably a short alkyl chain such as methyl, ethyl, propyl or butyl, are discussed in a number of documents including European Patents 70074, 75995 and 317614 (WO 88/9369), GB 2185991, U.S. Pat. No. 3,598,865, U.S. Pat. No. 4,011,389 and U.S. Pat. No. 4,565,647. Processes for their preparation are disclosed in U.S. Pat. No. 3,598,865. Some of these materials are commercially available. These can be reacted with a branched primary alcohol to produce alkyl polyglycosides with two long alkyl or alkenyl chains.

Compounds in this category could be represented by the formula:

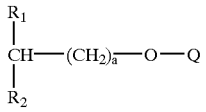

where Q is a hydrophilic group containing more than one glycoside ring and the linking group is:

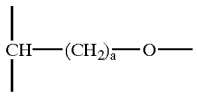

where "a" is 2 or more, preferably 2 to 6, e.g. 2 to 4.

Compounds of the general formula:

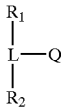

where Q denotes a polyoxyalkylene chain, can be made by reaction of alkylene oxide and a branched primary alcohol, branched primary amine, guerbet acid or other compounds containing $R_1$ and $R_2$ attached to a group which includes:

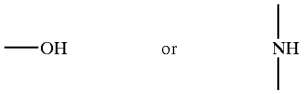

Product Form

The present invention may be utilised in various forms of fabric treatment product. Particularly envisaged is a rinse conditioner formulation for addition to water used for rinsing fabrics after washing. However, the invention can also be embodied in other product forms as will be mentioned again below.

Rinse conditioner compositions of this invention preferably do not include any substantial amount of synthetic anionic detergent because such detergent may dissolve the desired liquid crystalline phase. Water soluble soaps, with chain lengths of $C_{14}$ or less should be avoided for the same reason. Thus, the total amount of synthetic anionic detergent or water-soluble soap (if any) should preferably not exceed 10% by weight of the total amount of the required nonionic surfactants, more preferably not exceed 10% by weight of the total softener content.

When a composition of the present invention is a rinse conditioner, it may contain the fabric softening material as a dispersion in water at a total amount in the range from 2% to 30% by weight. Rinse conditioners can also be embodied in other forms such as powders and pastes.

A composition which is for use as a rinse conditioner will generally not include any significant amount of detergency builders. Thus, the total amount of insoluble aluminosilicate and water soluble tripolyphosphate (two common detergency builders) will generally be less than 5% by weight of the composition. Usually these will be entirely absent.

A rinse conditioner composition could include a cationic fabric softener, although certain forms of the present invention do not use cationic materials. Therefore, the total quantity of the nonionic fabric softening material of this invention may be at least half, more preferably equal to or greater than the total quantity of cationic softener present, if indeed any cationic softener is present. It is especially preferred that the total quantity of the required nonionic surfactants may be more than 3 or 4 times the total quantity, if any, of cationic softeners.

Suitable cationic softeners include quaternary ammonium materials comprising a polar head group and two alkyl or alkenyl chains.

Preferred quaternary ammonium materials are substantially water insoluble. Substantially insoluble fabric softening compounds in the context of this invention are defined as fabric softening compounds having a solubility less than $1\times10^{-3}$ wt % in demineralised water at 20° C., preferably the fabric softening compounds have a solubility less than $1\times10^{-4}$, most preferably the fabric softening compounds have a solubility at 20° C. in demineralised water from $1\times10^{-6}$ to $1\times10^{-8}$ wt %.

Particularly preferred quaternary ammonium materials are a water insoluble quaternary ammonium materials which comprises a compound having two $C_{12-18}$ alkyl or alkenyl groups connected to the molecule via at least one an ester link. It is more preferred if the quaternary ammonium material has two ester links present. The preferred ester-linked quaternary ammonium material for use in the invention can be represented by the formula:

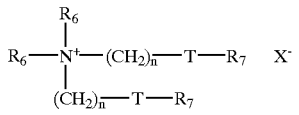

wherein each $R_6$ group is independently selected from $C_{1-4}$ alkyl, hydroxyalkyl or $C_{2-4}$ alkenyl groups; and wherein each $R_7$ group is independently selected from $C_{8-28}$ alkyl or alkenyl groups;

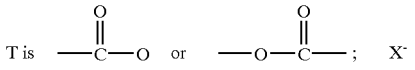

is any suitable anion such as halide or lower alkosulphate and N is O or an integer from 1–5.

Especially preferred materials within this class are di-alkenyl esters of triethanol ammonium methyl sulphate and N-N-di(tallowoyloxy ethyl)N,N-dimethyl ammonium chloride. Commercially available examples of compounds within this formula are Tetranyl (RTM) AOT-1 (di-oleic ester of triethanol ammonium methyl sulphate 80% active), Tetranyl AO-1(di-oleic ester of triethanol ammonium methyl sulphate 90% active), Tetranyl L1/90 (partially hardened tallow ester of triethanol ammonium methyl sulphate 90% active), Tetranyl L5/90 (palm ester to triethanol ammonium methyl sulphate 90% active, Tetranyl AHT-1 (fully hardened tallow ester of triethanol ammonium methyl sulphate 90% active) (all ex Kao corporation) and Rewoquat (RTM) WE15 ($C_{10}$–$C_{20}$ and $C_{16}$–$C_{18}$ unsaturated fatty acid reaction products with triethanolamine dimethyl sulphate quaternised 90% active), ex Witco Corporation.

A second preferred type of quaternary ammonium material can be represented by the formula:

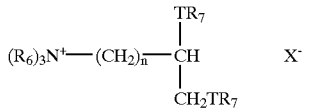

wherein $R_6$, $R_7$, $X^-$, T and n are as defined above.

Preferred materials of this class such as 1,2 bis [hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as describe din U.S. Pat. No. 4,137,180 for example 1-hardened tallowoyloxy-2-hydorxy trimethylammonium propane chloride.

A rinse conditioner composition may also include other nonionic softener compounds. A particularly preferred nonionic softening component is an oily sugar derivative of a cyclic polyol or of a reduced saccharide, said derivative resulting from 35 to 100% of the hydroxyl groups in said polyol or in said saccharide being esterified or etherified, and wherein said derivative has two or more ester or ether groups independently attached to a $C_8$–$C_{22}$ alkyl or alkenyl chain. The oily sugar derivative preferably comprises a mixture of tallowyl and oleyl chains.

Other constituents which may be incorporated into such a rinse conditioning composition are perfumes, perfume carriers, polymeric thickeners, drape imparting agents, anti-static agents, germicides, fungicides and ironing aids, such as silicones.

Materials which enhance deposition on fabric may usefully be included. Such materials are often polymeric: GB-A-2266100 discloses certain cellulose ethers for this purpose and mentions earlier documents which proposed other materials able to bring about deposition.

Preferred deposition aids are cationic, especially single long chain cationic surfactants, such as cetyl trimethyl ammonium chloride (CTAC).

It is particularly preferred that a delivery aid is present when the softening agent does not possess amine functionality.

A rinse conditioning composition may be manufactured by making a melt of the fabric softening material(s), adding this to hot water e.g. at a temperature of 70–85° C., with mixing, and then mixing the composition with high shear until it is homogenous.

The invention can also be utilised in compositions used on an industrial scale for finishing newly manufactured fabric. Another possible application is products for spraying directly onto fabric, for example when ironing the fabric after it has been dried.

Yet another application is in products to be placed in a tumble dryer jointly with fabrics. For this, the fabric softening material of the present invention may be coated onto a flexible substrate which is capable of releasing the material in a tumble dryer. Such a product can be designed for single usage or for multiple uses and may be analogous to known products which use conventional cationic fabric softeners. One such multi-use article comprises a porous sponge material releasably enclosing enough of the fabric softening material to impart fabric softness during several drying cycles. In use, the material melts and leaches out through the pores of the sponge to soften and condition fabrics. A single use sheet may comprise the fabric softening material carried on a flexible substrate such as a sheet of paper or woven or non-woven cloth substrate. When such an article is placed in an automatic laundry dryer, the heat, moisture, distribution forces and tumbling action of the dryer removes the composition from the substrate and deposits it on the fabrics. Substrate materials for single use and multiple use articles, and methods of impregnating or coating them are discussed in U.S. Pat. No. 5,254,269 and elsewhere.

Another possible form of product embodying the invention is a detergent composition which is formulated to give fabric softening jointly with fabric washing.

If the product of the invention is used in a detergent composition for fabric washing, the composition will usually contain one or more detergency builders, suitable in an amount of from 5 to 60 or 80%, preferably from 20 to 60% by weight of the composition. Various classes of detergency builders are well known.

One well known class of builders is the alkali metal (preferably sodium) aluminosilicates. These may suitably be incorporated in amounts of from 5 to 60% by weight (anhydrous basis) of the composition, and may be either crystalline or amorphous or mixture thereof. These materials have the general formula:

$$0.8\text{–}1.5\ Na_2O.Al_2O_3.\ 0.8\text{–}6\ SiO_2$$

contain some bound water and are required to have a calcium ion exchange capacity of at least 50 mg CaO/g. The preferred sodium aluminosilicates contain 1.5–3.5 $SiO_2$ units (in the formula above).

Suitable crystalline sodium aluminosilicate ion-exchange detergency builders are described, for example, in GB 1429143 (Procter & Gamble). The preferred sodium aluminosilicates of this type are the well known commercially available zeolites A and X, and mixtures thereof. Also of interest is the novel zeolite P described and claimed in EP 384070 (Unilever).

Other builders may also be included in a detergent composition, as necessary or desired. Water-soluble builders may be organic or inorganic. Inorganic builders that may be present include alkali metal (generally sodium) carbonate, orthophosphate, pyrophosphate and tripolyphosphate. Organic builders include polycarboxylate polymers, such as polyacrylates, acrylic/maleic copolymers, and acrylic phosphates, monomeric polycarboxylates such as citrates, gluconates, oxydisuccinates, glycerol mono- di- and trisuccinates, carboxymethyloxysuccinates, carboxymethyloxymalonates, dipicolinates, hydroxyethyliminodiacetates; and organic precipitant builders such as alkyl- and alkenylmalonates and succinates.

Especially preferred supplementary builders for use jointly with aluminosilicate are polycarboxylate polymers, more especially polyacrylates and acrylic/maleic copolymers, suitably used in amounts of from 0.5% to 15%, especially from 1 to 10% by weight of the composition; and monomeric polycarboxylates, more especially citric acid and its salts, suitably used in amounts of from 3 to 20%, more preferably from 5 to 15% by weight of the composition.

Detergent compositions for fabric washing are customarily formulated using anionic surfactant(s) as at least part of the detergent active. However, compositions are known in which the detergent active is wholly or largely nonionic. It is envisaged that the present invention may, in particular, be embodied in built detergent composition where nonionic surfactants (including the fabric softening material required by this invention) are over 50%, probably at least 80% by weight of all surfactants present. Synthetic anionic surfactants may well be omitted entirely.

In a detergent composition for fabric washing the total amount of surfactant will generally lie in a range from 5 to 50%, more usually 5 to 40% by weight of the composition.

Detergent compositions in which the product according to the invention is present, may also contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272.

Detergent compositions of the invention may also contain one or more of the detergency enzymes known in the art for their ability to degrade and aid in the removal of various soils and stains. Suitable enzymes include the various proteases, cellulases, lipases, amylases, and mixtures thereof.

Further ingredients which can optionally be employed in a detergent composition of the invention include antifoams, fluorescers, anti-redeposition agents such as sodium carboxymethylcellulose, heavy metal sequestrants such as EDTA; perfumes; pigments, colorants or coloured speckles; and inorganic salts such as sodium and magnesium sulphate.

EXAMPLES

Synthesis of: N,N-dioctadecyl-1,3-propane-1,3-diamine

N,N-dioctadecyl-1,3-propane-1,3-diamine is a compound from which the compounds required by the invention can be prepared.

Stage 1:

Dioctadecyl amine (80 g, 0.153 moles) was placed in a three-necked round-bottomed flask (500 ml) together with distilled acrylonitrile (350 ml). The mixture was then refluxed as 90–95° C. for 24 hours. Excess acrylonitrile was then distilled off under reduced pressure. The residue was a yellowish waxy semi-solid. This product, N,N-dioctadecyl-2-amino ethyl cyanide, was purified by chromatography on a silica gel column eluting with a 2:1 mixture of petroleum ether and diethyl ether. The eluted material was recrystallised twice from acetone.

Stage 2:

The purified nitrile produced in stage 1 above was then reduced with lithium aluminium hydride.

200–250 ml of anhydrous diethyl ether was placed in a 1 liter two-necked round-bottomed flask. Lithium aluminium hydride (10.9 g) was then added to the diethyl ether and dispersed slowly with a magnetic stirrer.

The nitrile (40 g, 0.697 moles) was dissolved in diethyl ether (550 ml) and added dropwise to the reaction vessel.

The reaction mixture was allowed to reflux for 1.5 hours and then stirred for 72 hours at room temperature.

The reaction mixture was poured onto 1.5 liters of ice water to which 1 liter of 10% sodium bicarbonate solution was added. The aqueous phase was then extracted with 4 liters of diethyl ether. The organic phase was dried over sodium sulphate and the solvent removed under reduced pressure.

The product was dissolved in chloroform and dried over anhydrous sodium sulphate. The chloroform was then removed and the residue dried in a vacuum oven. The desired product was obtained (30 g; melting point of 45–48° C.).

Examples of the invention are denoted by a number and comparative examples are denoted by a letter.

Example 1

Synthesis of N,N-dioctadecyl Aminopropyl Lactobionamide (DASPL)

1.03 g (0.0030 moles) of lactobiono-1,5-lactone provided as 95% active (ex Solvay) and 100 ml of anhydrous methanol were placed in a 250 ml round-bottomed flask. 2 g (0.035 moles) of N,N-dioctadecyl propane-1,3-diamine, prepared as above, in 150 ml of hot methanol was added dropwise to the reaction vessel. The reaction mixture was stirred overnight. After the first 2 hours of stirring the contents seen to be very milky and viscous. Methanol was evaporated from the reaction mixture to leave a residue of the desired product.

The product was identified by $^{13}C$ and proton n.m.r analysis.

$^{13}C$-NMR. (DMSO-D6) at 330 K: peaks were observed at:

13.34, 13.36. 21.72, 26.45, 26.58, 28.38, 28.65, 28.71, 28.74, 30.99, 51.45, 53.18, 60.43, 62.25, 68.03, 70.34, 70.97, 71.36, 71.76, 73.12, 15.46, 82.62, 104.28, 171.69.

$^{1}H$ NMR analysis (DMSO-d6/CDC13): peaks were observed at:

0.0825 triplet ($CH_3$-terminal), 1.23 broad singlet ($CH_2$), 2.30 multiplet —($CH_2$)3-, 3.1–5.15 multiplet OH, H, 7.6 triplet (NH—C=O).

Infrared analysis in Nujol mull indicated the following peaks:

OH stretch at 3345 $cm^{-1}$, $CH_2$ at 2900 $cm^{-1}$, Amide I at 1644 $cm^{-1}$, Amide II at 1546 $cm^{-1}$, tertiary amine at 1062–1142 $cm^{-1}$.

Example 2

Synthesis of Stearyl Cocoamidopropyl Lactobionamide (SCAPL)

Cocoamidopropyl lactobionamide was prepared by reaction of cocoaminopropylamine and lactobiono-1,5-lactone in methanol with an acid catalyst.

60 g (0.102 moles) of the cocoamidopropyl lactobionamide and 450 ml of anhydrous methanol were placed in a three-necked round-bottomed flask equipped with mechanical stirrer and nitrogen inlet. Stearic anhydride (56.2 g, 0.102 moles) was added slowly while the reaction was stirred. The mixture was observed not be homogenous at room temperature. It was heated slowly to 70° C. so that the mixture became homogenous. It was then stirred at this temperature for 72 hours.

At the end of this period the reaction mixture was allowed to cool to room temperature. Ethyl acetate (500 ml) was then added to the mixture and stirred overnight. Solids were filtered off and washed several times in ethyl acetate and acetone then dried under vacuum. Approximately 52.2 g of material was obtained. Infrared peaks (nujol mull) were observed as follows:

OH stretch 3375 $cm^{-1}$; $CH_2$ stretch 2900 $cm^{-1}$

Amide I stretch 1644 $cm^{-1}$; Amide II stretch 1540 $cm^{-1}$.

Example 3

Synthesis of Distearyl Aminopropylgluconamide (DSAPG)

300 ml of anhydrous methanol and 4.27 g (0.024 moles) of delta-gluconolactone (ex Aldrich) were stirred in a 2 neck 500 ml round bottom flask. 14.0 g (1.024 moles) of N,N-dioctadecyl-1,3-propane-1,3-diamine, prepared as above was added in 3 g portions over 90 minutes. The reaction mixture became very thick after 2 hours and an additional 100 ml of anhydrous methanol was added. After 72 hours the product was recovered by filtration over Whatman (trade name) 41 filter paper and dried in a vacuum oven. The yield of this reaction was 94%.

A melting point of this material was taken; the material started to melt at 135° C. and was completely melted at 140° C.

$^{13}$-C-NMR analysis (DMSO-d6) at 333K; peaks were observed at:

13.08, 13.25, 21.71, 26.48, 26.62, 26.69, 28.39, 28.76, 30.99, 36.70, 51.48, 53.23, 63.18, 70.02, 71.41, 72.35, 73.25, 78.31, 171.81.

Infrared Analysis in Nujol mull indicated the following peaks:

Amide I stretch=1638$^{-1}$; Amide II stretch=1558 $cm^{-1}$

OH stretch 3357 $cm^{-1}$; $CH_2$ stretch 2972 $cm^{-1}$ tertiary amine stretch 1130, 1087, 1026 $cm^{-1}$

Example 4

Synthesis of Isofol-36 Oxypropyl Lactobionamide (IF 36-OPL)

Lactobiono-1,5-lactone (1.0 g, 0.003 mole) and 70 ml of anhydrous methyl alcohol were mixed in a 100 ml round bottom flask. A catalytic amount of dry p-toluenesulphonic acid was added and the reaction mixture was refluxed for 24 hours. After this time, Isofol-36-oxypropylamine (1.73 g, 0.003 mole), dispersed in anhydrous methanol (20 ml), was added dropwise and reflux was continued for a further 24 hours. After this time, the methanol was removed under reduced pressure to obtain Isofol-36 oxypropyl lactobionamide as an off-white solid which was washed several times with diethyl ether and used without further purification.

FT-IR(nujol mull): 3364 $cm^{-1}$ (OH stretch), 2900 $cm^{-1}$ ($CH_2$ stretch), 1658 $cm^{-1}$ (Amide I stretch), 1545 $cm^{-1}$ (Amide II stretch).

$^{13}C$-NMR(d6-DMSO) at 330K: Peaks observed at 13.35, 21.74, 25.88, 28.41, 28.66, 28.76, 29.08, 29.26, 30.50, 31.02, 35.65, 37.33, 60.45, 62.24, 68.06, 70.36, 70.98, 71.36, 71.80, 73.12, 73.36, 75.48, 82.64, 104.29.

The compounds of examples 1 to 4 have the following structures:

Example 1-DSAP-L

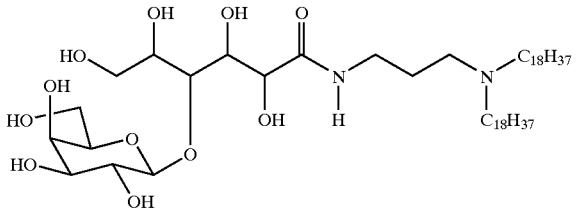

Example 2-SCAP-L

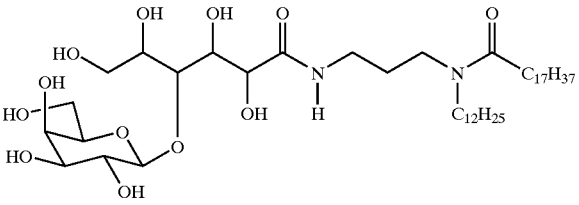

Example 3-DSAP-G

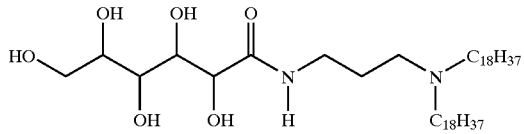

-continued

Example 4-IF36-OPL

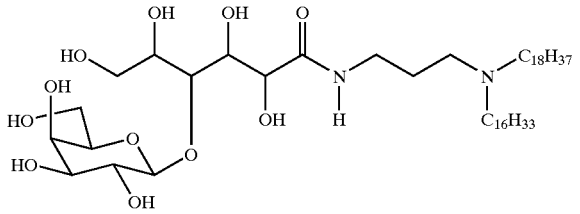

Example A

Preparation of Isofol 36 EO-8 (IF36 EO-8)

Isofol 36 is 2-octadecyl octadecanol, a Guerbet alcohol (ex Condea). It was ethoxylated, by standard methods for ethoxylation of fatty alcohols, to give a product containing an average of 8 moles ethylene oxide per mole of Isofol 36.

Example B

Preparation of Isofol 36 EO-12 (IF36 EO-12)

Example A was repeated, but ethoxylating to an average of 12 ethylene oxide moles per mole of Isofol 36 instead.

Example C

Preparation of Isocarb-36 Glucamide (IC36-GA)

Isocarb-36 acid (15 mmole, ex Condea), suspended in dry dichloromethane (100 $cm^{-3}$), was heated to 40° C. with stirring, under an atmosphere of nitrogen. Oxalyl chloride in dichloromethane (12 $cm^{-3}$ of 2M solution, i.e. 24 mmole) was added over 20 minutes, the Isocarb-36 acid slowly dissolving. The reaction mix was heated for 4 hours at 40° C. and then the dichloromethane and excess oxalyl chloride were removed under vacuum to give a liquid which solidified on cooling.

Infra-red analysis in Nujol mull was used to confirm that the acid chloride had formed (carbonyl band at 1789.6 $cm^{-1}$).

To a stirred solution of D-glucamine (28 mmole, ex Fluka) in tetrahydrofuran/water (100 $cm^3$/62 $cm^3$) at 0–5° C., a solution of Isocarb-36 acid chloride (14 mmole) in tetrahydrofuran (50 $cm^3$) was added over 30 mins. A white precipitate slowly formed. When the addition was complete, the reaction mixture was allowed to warm to ambient temperature overnight and then poured into a separating funnel containing water (50 $cm^3$) and tetrahydrofuran (100 $cm^3$). On shaking, a white emulsion was formed. The separating funnel and its contents were warmed on a steam bath to aid separation of the layers. The aqueous layer was run off and the organic layer washed with brine (with warming to aid separation) and then evaporated to yield Isocarb-36 Glucamide as a white solid (m.pt. 162.5° C.).

$^{13}C$ NMR at 330K (in $CDCl_3/d_6$-DMSO) showed a peak at 174.5 ppm (amide carbonyl).

Infra-red analysis in Nujol mull confirmed a secondary amide stretch at 1636–1647 and 1547 $cm^{-1}$.

Example D

Preparation of Isocarb-36 [N-Hydroxyethyl] glucamide (IC36-HEGA)

IC36-HEGA was prepared according to the method defined for example C except that the starting material was N-(2-hydroxyethyl)-D-glucamine.

Example E

Preparation of Isofol-36 Maltoside (IF36-MA)

IF36-M heptaacetate was first prepared in the following manner:

To a 250 ml round bottom flask was added 4.0 g (0.0057 moles) of acetobromomaltose dissolved in 150 ml of anhydrous methylene chloride. Silver carbonate (1.20 g, 0.0043 moles) and iodine (0.07 g) were added to the reaction vessel and stirred. After a few minutes, Isofol-36(3.27 g, 0.0063 moles) was added gradually. After 24 hours the reaction was worked up by filtering through 50 g of celite. The filtered material was chromatographed on a silica gel column using 3:1 hexane:ethyl acetate mix to obtain 2.0 g of the desired material.

$^{13}C$-NMR($CDCl_3$) at 330 K: peaks were observed at 14.21, 20.64, 20.74, 20.90, 21.00, 22.78, 26.70, 26.89, 29.46, 29.80, 30.14, 30.97, 31.19, 32.01, 38.05, 61.61, 63.02, 68.13, 58.55, 69.44, 70.09, 72.10, 72.30, 72.92, 73.13, 75.58, 95.57, 100.71, 169.47, 169.51, 170.35, 170.51, 170.56, 170.59.

FT-IR analysis (neat) showed peaks at 2929 $cm^{-1}$, 2855.77 $cm^{-1}$ and 1760.49$^{-1}$.

The acetate groups were removed in the following manner:

To a 250 ml round bottom flask was added 6.0 g (0.0058 moles) of the Isofol-36 maltoside heptaacetate in 100 ml of methyl alcohol, 2 ml of triethylamine and 1 ml of water. The reaction was refluxed for 48 hours and monitored by FT-IR for the disappearance of the ester group. The solvent was removed under reduced pressure and the residue washed with cold water and dried to give the required produce: Isofol-36 maltoside.

Example F

Preparation of Isofol-36 Melibioside (IF36-MB)

IF36-MB heptaacetate was first prepared in the following manner:

To a 250 ml round bottom flask were added 14.14 g (0.020 moles) of acetobromomelibiose dissolved in 100 ml of anhydrous methylene chloride. Silver carbonate (5.51 g, 0.0043 moles) was added to the reaction and stirred. Isofol-36 (10.44 g, 0.020 moles) was then added gradually to the reaction after a few minutes. The reaction was allowed to run for 24 hours and worked up by filtering through 50 g celite. This material was chromatographed on a silica gel column using a gradient elution. The excess Isofol-36 was removed with 100% chloroform and then the desired material was isolated using 3:1 hexanes:ethyl acetate.

$^{13}C$-NMR($CDCl_3$) at 330 K: peaks observed at 14.21, 20.64, 20.90, 21.00, 22.69, 29.36, 29.70, 31.94, 38.05, 61.65, 65.87, 66.40, 67.45, 67.68, 68.13, 68.56, 69.31, 69.93, 70.29, 70.52, 70.52, 168.83, 169.31, 169.66, 169.82, 170.16, 170.20, 170.34.

The acetate groups were removed in the following manner:

To a 250 ml round bottom flask were added 3.5 g (0.0034 moles) of the Isofol-36 melibioside heptaacetate in 100 ml of methyl alcohol, 2 ml of triethylamine and 1 ml of water. The reaction was refluxed for 48 hours and monitored by FT-IR for the disappearance of the ester group. The solvent was removed under reduced pressure and the residue washed with cold water to give the desired product: Isofol-36 melibioside.

Softness Evaluation

Fabric softening materials prepared as in Example 1–3 were made into aqueous rinse conditioner formulations containing 5% by weight, based on the total weight of the composition, of the fabric softening material. In each case, preparation was carried out by heating the appropriate quantity of the material in water at 80° C., with occasional agitation, until a homogenous dispersion was formed.

After cooling the formulations were tested to evaluate their fabric softening efficacy. For this the formulations were diluted with tap water, 10° French Hardness (FH) to provide rinse liquors containing 0.1 g/liter of the fabric softening material.

One control consisted of water only. Another control was provided by a cationic material (HT TMAPC) formulated at a concentration of 2.5% by weight and then used at a concentration of 4 g/liter so as again to provide 0.1 g/liter by weight in the treatment liquor. Further controls were sucrose distearate, a compound in which the aliphatic stearoyl chains are attached to different hydroxyl groups of sucrose, and di (hardened tallow) methylamine which has been used as a softening additive in detergent compositions.

The test fabric was terry towelling which has previously been washed to remove any filler or dressing applied during manufacture. 1 liter of the treatment liquor was placed in each Tergotometer (trade-name) pot. Three pieces of terry towelling (8 cm×8 cm, 40 g total weight) were then added to each of the tergotometer pots, and each load was spun for 5 minutes at 65 rpm, then spin dried to remove excess liquor and line dried overnight.

Softening of the fabrics was assessed by an expert panel of 6 people. Each panel member assessed 3 cloths treated with either a formulation of the invention or a comparative formulations, and also assessed 3 control cloths respectively treated with HT TMAPC or water only.

Panel members were asked to assess softness on an 8 point scale, where a score of 8 represents unsoftened fabric and a score of 2 represents extremely soft fabric. Thus, lower values are indicative of better softening.

The results given in table 1 represent an average of all of the scores given.

TABLE 1

| Composition of Example No. | Softness ranking |
|---|---|
| 1 (DSAPL) | 3.25 |
| 2 (SCAPL) | 5.0 |
| 3 (DSAPC) | 4 |
| A (IF36-E08) | 6.5 |
| B (IF36-E012) | 7.5 |
| E (IF36 MA) | 7.75 |
| Control HT TMAPC | 3.5 |
| Water only | 8 |

The results show that the compositions containing the products of the invention generally provided improved softening of fabrics over the comparative example, and comparable softening to the premium commercially available softener, HT TMAPC.

Phase Evaluation

The products of the invention and a number of comparative compounds were examined to determine the surfactant phase which they adopt when added at a concentration of 1% by weight to water at 20° C. which is adjusted for pH 7 but is otherwise deionised.

The phases observed are set out in table 2.

TABLE 2

| Composition of Example No. | | Phase |
|---|---|---|
| 1 | (DSAPL) | L-beta |
| 2 | (SCAPL) | L-alpha |
| 3 | (DSAPG) | D-hydrated solid |
| A | IF36 E0-8 | L-beta |
| B | IF36 E0-12 | L-beta |
| Comparison | IF32-EO4 | Reverse cubic |
| Comparison | SDS | Hydrated solid |
| Control | DHTMA | Insoluble |

What is claimed is:

1. A fabric softening product comprising:

a) as a softening agent, at least one organic compound of the general formula:

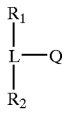

which does not contain any cationic quaternary nitrogen group and in which formula:

Q denotes a hydrophilic aliphatic head group (i) containing at least six free hydroxyl groups, and wherein there are no more than two carbon atoms for every hydroxyl group;

$R_1$ and $R_2$ each independently denote a hydrophobic aliphatic chain of 5 to 40 carbon atoms optionally interrupted by a heteroatom, provided that $R_1$ and $R_2$ together contain at least 26 carbon atoms, and L denotes a linking group providing at least 1, preferably 2, single bonds capable of providing freedom of rotation and a chain of at least 4 atoms but not more than 10 atoms, between Q and $R_1$ and between Q and $R_2$;

wherein said linking group L is attached to a hydroxy-substituted carbon atom in the hydrophilic group Q; and b) a carrier therefor.

2. A product according to claim 1 wherein the linking group, L, provides a chain length of from four to six atoms between $R_1$ and Q and between $R_2$ and Q.

3. A product according to claim 1 wherein the linking group L provides a chain length of one to three atoms between the groups $R_1$ and $R_2$.

4. A product according to claim 1 in which either the linking group L or the hydrophilic head group Q includes a nitrogen atom capable of being protonated.

5. A product according to claim 3 in which the linking group L contains a nitrogen atom to which the hydrophilic head group Q is attached.

6. A product according to claim 1 wherein Q denotes an aliphatic group (i) which contains residues of more than one glycoside ring.

7. A product according to claim 6 wherein Q denotes an aliphatic group (i) which contains a carbon chain bearing at least two free hydroxyl groups and, joined thereto, at least one cyclic glycoside residue bearing free hydroxyl groups.

8. A product according to claim 1 wherein the hydrophobic aliphatic chains $R_1$ and $R_2$ each contain from 12 to 20 more preferably 16 to 18 carbon atoms.

9. A product according to claim 1 wherein the organic compound (a) is free of anionic groups.

10. A product according to claim 1 wherein the organic compound(s) (a) form an $L_\beta$ lamellar liquid crystal phase when dispersed at a concentration of 1% by weight in deionised water at 20° C. and adjusted to pH 7.

11. A product according to claim 1 which is an aqueous rinse conditioner composition wherein the carrier (b) comprises water and said fabric softening compound (a) is dispersed therein.

12. A product according to claim 1 which is in the form of a product for use in a tumble dryer wherein the said carrier (b) is a porous article and the said fabric softening organic compound (a) impregnates the said article.

13. A product according to claim 1 wherein Q denotes a di-saccharide group.

14. A product according to claim 1 wherein said product is a rinse conditioner or a tumble dryer sheet.

15. A product according to claim 1 wherein said hydrophilic head group Q is ethoxylated.

* * * * *